US008120457B2

(12) United States Patent
Hu et al.

(10) Patent No.: US 8,120,457 B2
(45) Date of Patent: Feb. 21, 2012

(54) CURRENT-CONTROLLED VARIABLE INDUCTOR

(75) Inventors: Yuequan Hu, Morrisville, NC (US); Laszlo Huber, Cary, NC (US); Milan Jovanović, Cary, NC (US)

(73) Assignee: Delta Electronics, Inc., Taipei (TW)

( * ) Notice: Subject to any disclaimer, the term of this patent is extended or adjusted under 35 U.S.C. 154(b) by 127 days.

(21) Appl. No.: 12/757,296

(22) Filed: Apr. 9, 2010

(65) Prior Publication Data

US 2011/0248812 A1 Oct. 13, 2011

(51) Int. Cl.
*H01F 17/06* (2006.01)

(52) U.S. Cl. ..... 336/178

(58) Field of Classification Search ..... 336/170, 336/173, 178, 180–184, 212, 220–223, 214–215
See application file for complete search history.

(56) References Cited

U.S. PATENT DOCUMENTS

| | | | | |
|---|---|---|---|---|
| 3,873,910 | A | 3/1975 | Willis, Jr. | |
| 3,965,408 | A * | 6/1976 | Higuchi et al. | 363/75 |
| 4,162,428 | A | 7/1979 | Elms | |
| 4,206,434 | A * | 6/1980 | Hase | 336/5 |
| 4,259,716 | A * | 3/1981 | Harris et al. | 363/97 |
| 4,393,157 | A | 7/1983 | Roberge et al. | |
| 4,853,611 | A | 8/1989 | Kislovski | |
| 4,992,919 | A | 2/1991 | Lee et al. | |
| 4,994,952 | A * | 2/1991 | Silva et al. | 363/56.01 |
| 5,999,077 | A | 12/1999 | Hammond et al. | |
| 6,950,319 | B2 | 9/2005 | Huber et al. | |
| 7,242,275 | B2 * | 7/2007 | Poniatowski et al. | 336/226 |

OTHER PUBLICATIONS

Y. Hu, L. Huber, and M.M. Jovanovic, "Single-Stage Flyback Power-Factor-Correction Front-End End for HB LED Application," Proc. of IAS 2009, Oct. 2009.

W.H. Wolfle and W.G. Hurley, "Quasi-Active Power Factor Correction With a Variable Inductive Filter: Theory, Design and Practice," IEEE Trans. Power Electronics, vol. 18, No. 1, pp. 248-255, Jan. 2003.

Magnetics Powder Cores, Brochure, available at www.mag-inc.com/products/powder_cores, Oct. 2008.

A.S. Koslovski, "Quasi-Linear Controllable Inductor," Proceedings of the IEEE, vol. 75, No. 2, pp. 267-269, Feb. 1987.

A.S. Koslovski, "Relative Incremental Permeability of Soft Ferrites as a Function of the Magnetic Field H: An Analytic Approximation," IEEE Power Elecgtronics Specialists Conf. (PESC), pp. 1469-1475, 1996.

(Continued)

*Primary Examiner* — Tuyen Nguyen
(74) *Attorney, Agent, or Firm* — Venable LLP; Robert S. Babayi; Christopher Ma

(57) ABSTRACT

A variable inductor comprises one or more magnetic cores providing magnetic flux paths. An inductor coil is wound around one or more inductor sections of the one or more magnetic cores. An inductor magnetic flux flows through one or more closed flux paths along the inductor sections of the magnetic core. A control coil is wound around one or more control sections of the one or more magnetic cores. A control magnetic flux flows through one or more closed flux paths along the control sections of the magnetic core. Under this arrangement, the inductor magnetic flux substantially does not flow through the control sections of the magnetic core and the control magnetic flux substantially does not flow through the inductor sections of the magnetic core. The closed flux paths associated with the inductor magnetic flux and the closed flux paths associated with the control magnetic flux share one or more common sections of the magnetic core not including the control sections and inductor sections. The inductance of said variable inductor is varied by varying said control magnetic flux.

18 Claims, 14 Drawing Sheets

OTHER PUBLICATIONS

D. Medini and S.B. Yaakov, "A Current-Controlled Variable-Inductor for High Frequency Resonant Power Circuits," Proc. IEEE Applied Power Electronics Conf. (APEC), pp. 219-225, 1994.

Z.H. Meiksin, "Comparison of Orthogonal- and Parallel-Flux Variable Inductors," IEEE Trans. Industry Applications, vol. IA-10, No. 3, pp. 417-423, May/Jun. 1974.

* cited by examiner (a)

(b)

CURRENT-CONTROLLED VARIABLE INDUCTOR

BACKGROUND OF THE INVENTION

1. Field of the Invention

This present invention generally relates to the field of inductors, and more particularly, to an inductor with variable inductance.

2. Description of the Prior Art

Some cost-effective power converters with power factor correction (PFC) for universal-line-voltage (90-270 Vrms) applications require a variable PFC inductance to meet the requirements for line-current harmonics and power factor set by different standards and programs. For example, Light-Emitting Diode (LED) drivers with an input power over 25 W in general lighting applications are required to meet the line-current-harmonic limits set by the IEC 61000-3-2 Class C and JIS C 61000-3-2 Class C standards.

A good candidate for the universal-line LED driver applications is the single-stage PFC flyback topology shown in FIG. 1, as disclosed in U.S. Pat. No. 6,950,319 to L. Huber, M. M. Jovanović, and C. C. Chang, entitled "AC/DC flyback converter," due to its low component count and low cost. In this converter, the PFC part operates in discontinuous conduction mode (DCM), while the dc/dc part operates at the DCM/CCM (continuous conduction mode) boundary. A low line-current harmonic distortion can be achieved due to the inherent property of the DCM boost converter to draw a near sinusoidal current if its duty cycle is held relatively constant during a half line cycle. However, voltage $V_B$ across bulk capacitor $C_B$ is not regulated and at high line it can increase to impractical levels. To reduce the bulk-capacitor voltage, one terminal of the boost inductor winding is connected to a tapping point of the primary winding of the flyback transformer, which provides a negative magnetic feedback. However, the tapping of the flyback primary winding also results in a zero-crossing distortion of the line current. In fact, as long as the instantaneous line voltage is lower than the voltage at the tapping point, no current is drawn from the input, which deteriorates the power factor and the line-current harmonics.

The single-stage PFC flyback topology with a constant inductance $L_B$ in FIG. 1 has been successfully applied in adapter/charger applications for the universal line voltage, where the line-current harmonics have to meet the IEC 61000-3-2 Class D and JIS C 61000-3-2 Class D limits. However, applying the single-stage PFC flyback topology with a constant inductance $L_B$ in FIG. 1 for lighting applications, where the line-current harmonics have to meet the more stringent limits set by the IEC 61000-3-2 Class C and JIS C 61000-3-2 Class C standards, presents a challenging task.

As voltage $V_B$ across bulk-capacitor $C_B$ in FIG. 1 is not regulated and varies with both the input voltage and output power, the design of the magnetic components significantly affects the bulk-capacitor voltage level. Generally, a higher boost inductance $L_B$ leads to a lower voltage $V_B$. In fact, if the boost inductance increases during steady-state operation, the input power initially decreases because of a lower input current. The difference between the output power and input power has to be supplied from the bulk capacitor, causing a drop of the bulk-capacitor voltage. Meanwhile, as the bulk-capacitor voltage decreases, the duty cycle of main switch $Q_1$ increases to keep the output voltage regulated, resulting in an increase of the input power until a new balance between the input and output power is reached. A higher boost inductance can limit voltage $V_B$ to an acceptable level (i.e., less than 450 V) and ensure DCM operation at high line (180-270 Vrms).

However, at low line (90-135 Vrms), if the boost inductance is larger than the maximum value for DCM operation, the boost inductor will enter CCM operation around the peak of the rectified line voltage, and the line current waveform will have a bulge around its peak value, resulting in an increased total harmonic distortion (THD). Furthermore, if the bulk-capacitor voltage is slightly lower than the peak of the rectified line voltage, peak charging of the bulk capacitor through the bridge rectifier will also result in a bulge in the line current waveform with an increased THD.

It was shown in "Single-stage flyback power-factor-correction front-end for high-brightness (HB) LED application," by Y. Hu, L. Huber, and M. M. Jovanović, Proc. IEEE Industry Applications Society (IAS) 2009, that the single-stage PFC flyback in FIG. 1 with a constant boost inductance cannot be designed to achieve a practical bulk-capacitor voltage level at high line while meeting the JIS C 61000-3-2 Class C line-current harmonic limits at low line. To overcome these limitations, a variable boost inductance is required, i.e., a high boost inductance at high line to limit the bulk-capacitor voltage and a lower boost inductance at low line to ensure DCM operation and a low THD.

Inductors with variable inductance are known in prior art and they can be classified in three groups.

The first group includes methods where the inductance is varied by changing the path of the magnetic flux by using a short-circuited control winding. For example, see 1) U.S. Pat. No. 3,873,910 to C. A. Willis, entitled "Ballast control device," and 2) U.S. Pat. No. 4,162,428 to Robert T. Elms, entitled "Variable inductance ballast apparatus for HID lamp."

FIG. 2 shows a prior art variable inductor for use in lamp ballasts, as disclosed in U.S. Pat. No. 3,873,910. As shown in FIG. 2, the variable inductor comprises a main winding and a control winding positioned on the opposite sides of an added, gapped shunt. When the control winding is shorted by closing the triac switch, a current flows through the control winding generating a magnetic flux opposing the main flux induced by the main winding. As a result, the main flux path is forced to pass through the shunt. Since the gapped magnetic shunt has a higher reluctance than the flux path around the closed core, the inductance of the device is decreased. Therefore, the lamp current and the lamp power are increased.

FIG. 3 shows a prior art variable inductor for use in ballasts for HID lamps, as disclosed in U.S. Pat. No. 4,162,428. The control winding is wound around one outer leg of the EI magnetic core. Similarly as in the previous case, when the control switch is closed, a current flows through the control winding generating a magnetic flux opposing the main flux induced by the main winding, and the main flux path is forced to pass through the other outer leg of the core which has a gap, causing a decrease of the inductance and increase of the lamp current and power.

A major drawback of the methods disclosed in U.S. Pat. No. 3,873,910 and No. 4,162,428 is that a short circuit is created when the control switch is closed, resulting in a significant power loss in the control winding and switch.

In the second group, the inductance is varied by changing the size of the non-magnetic gap along the magnetic flux path either mechanically by using, for example, an actuator made of piezoceramic material that changes its length in response to an applied voltage, as disclosed in U.S. Pat. No. 5,999,077 to R. E. Hammond, E. F. Rynne, and L. J. Johnson, entitled "Voltage controlled variable inductor," or by a non-uniform gap construction such as a stepped gap or a sloped gap as described in "Quasi-active power factor correction with a variable inductive filter: theory, design and practice" by W. H.

Wölfle and W. G. Hurley, IEEE Transactions on Power Electronics, vol. 18, no. 1, pp. 248-255, January 2003.

In U.S. Pat. No. 5,999,077, a voltage-controlled variable inductance is disclosed, where an actuator, made of piezoceramic material that changes its length in response to an applied voltage, is fastened in the window area of the core in order to change the length of the air gap between the two parts of the magnetic core, resulting in a variation of the inductance. However, the inclusion of the actuator requires a complex implementation.

In the paper by Wölfle, variation of the inductance is achieved by varying the length of the air gap either in a discrete step (stepped air gap) or with a graded slope (sloped air gap). The value of the inductance varies with the inductor current. In fact, the core of the inductor with the stepped air gap (also called swinging inductor) can be considered to have two parallel reluctance paths, each path having two reluctances in series, the core and the gap. As the current increases, the path containing the smaller gap reaches saturation first and the increased reluctance reduces the overall inductance. The sloped air-gap inductor operates on the same principle; however, the variation of the inductance with the current is more gradual. Generally, manufacturing inductors with a stepped or sloped air gap is more complex than manufacturing inductors with a constant-length air gap, resulting in an increased cost.

The variable inductors built by using powdered metal cores with distributed air gap (see, for example, www.mag-inc.com/products/powder_cores) also belong to the second group. The powdered metal cores exhibit a soft saturation property, i.e., their permeability gradually decreases as the magnetizing force increases. However, the powdered metal cores have significantly higher loss than the corresponding ferrite cores.

The third group includes methods where the inductance is varied by adding a dc bias flux to the main magnetic flux. For example, see 1) U.S. Pat. No. 4,992,919 to C. Q. Lee, K. Siri, and A. K. Upadhyay, entitled "Parallel resonant converter with zero voltage switching;" 2) "Quasi-linear controllable inductor" by A. S. Kislovski, Proceedings of the IEEE, vol. 75, no. 2, pp. 267-269, February 1987, (Kislovski, 1987); 3) U.S. Pat. No. 4,853,611 to A. Kislovski, entitled "Inductive, electrically-controllable component;" 4) "Relative incremental permeability of soft ferrites as a function of the magnetic field H: an analytic approximation," by A. S. Kislovski, Rec. IEEE Power Electronics Specialists Conf. (PESC), pp. 1469-1475, 1996, (Kislovski, 1996); 5) "A current-controlled variable-inductor for high frequency resonant power circuits" by D. Medini and S. B. Yaakov, Proc. IEEE Applied Power Electronics Conf. (APEC), pp. 219-225, 1994; and 6) U.S. Pat. No. 4,393,157 to G. Roberge and A. Doyon, entitled "Variable inductor."

FIG. 4 shows a prior art variable inductor where an inductor winding and a control winding are wound on the same magnetic core, as disclosed in U.S. Pat. No. 4,992,919. A dc bias current $I_{BIAS}$ flowing through the control winding produces a bias magnetic flux $\Phi_C$. The main magnetic flux $\Phi_{LO}$ produced by the inductor current is superimposed on the bias magnetic flux $\Phi_C$.

FIG. 5 shows a graph of the relationship between the magnetizing field (H) and magnetic field (B) for the prior art variable inductor of FIG. 4. As the dc bias magnetizing force increases, the permeability of the core material, i.e., the slope of the B-H curve $$\left(= \lim_{\Delta H \to 0} \Delta B / \Delta H\right)$$

decreases, leading to a decreased inductance. A drawback of this method is that the control winding is strongly coupled with the inductor winding, resulting in undesired induced ac current and, consequently, power loss in the control winding.

FIG. 6 shows a prior art variable inductor where the inductor winding is divided into two identical portions, which are wound on two identical toroidal cores and connected in series so as to produce opposing fluxes through the control winding, which is wound over both cores, as proposed in the paper by Kislovski, 1987, and in U.S. Pat. No. 4,853,611. Ideally, due to the opposing fluxes, there is no coupling between the inductor and control windings.

FIG. 7 shows graphs of the relationship between the magnetizing field (H) and magnetic field (B) for the two individual cores of the variable inductor in FIG. 6: (a) without and (b) with a control current in the control winding. As shown in FIG. 7(*a*), without a bias current in the control winding, both cores exhibit the same flux density variation, i.e., $\Delta B_1 = \Delta B_2$, Therefore, the total inductance is twice the inductance of the individual inductor windings. Additionally, the induced voltage in the control winding is zero due to the equal but opposing fluxes through the control winding. However, with a bias current in the control winding, a biasing field $H_0$ is produced which displaces the operating point of the cores along their B-H curves, as shown in FIG. 7(*b*). One core (core 1) operates in the non-linear to saturation region, whereas the other core (core 2) operates in the non-linear to linear region along their respective B-H curves. As a result, the flux density variation and, consequently, the permeability in both cores are reduced compared to the case without a DC bias. Therefore, the total inductance is reduced. In addition, the flux density variation in core 1 is smaller than that in core 2, i.e., $\Delta B_1 < \Delta B_2$. Consequently, the total flux density variation through the control winding is not zero, resulting in undesired induced ac voltage and power loss in the control winding.

FIG. 8 shows another prior art implementation of the variable inductor in FIG. 6 as described in the paper by Kislovski, 1996, where instead of two toroidal cores a pair of E cores is used.

FIG. 9 shows a prior art modification of the variable inductor in FIG. 6 as disclosed in U.S. Pat. No. 4,853,611, where both the inductor winding and control winding are each divided into two identical portions, wound on two toroidal cores, and connected in series. Under this arrangement, the principle of operation and, consequently, the drawbacks of the variable inductor in FIG. 9 are the same as those of the variable inductor in FIG. 6.

FIG. 10 shows a prior art variable inductor, as proposed in the paper by Medini, which is similar to the variable inductor in FIG. 8, with the difference that the positions of the inductor winding and control winding are flipped. Specifically, the control winding is divided into two identical portions wound around the outer legs of the EE core and connected in series, while the inductor winding is wound around the center leg of the EE core. Also, the air gaps from the outer legs of the EE core are moved to the central leg. Under this arrangement, the basic operation and, consequently, the drawbacks of the variable inductor in FIG. 10 are the same as those of the variable inductor in FIG. 6.

In U.S. Pat. No. 4,393,157, a dc bias flux is added orthogonally to the main magnetic flux, which requires a complex magnetic core structure. In addition, orthogonal-flux inductors exhibit a smaller inductance variation than the parallel-flux inductors at the same control-current variation, as explained in "Comparison of orthogonal- and parallel-flux variable inductors," by Z. H. Meiksin, IEEE Trans. Industry Applications, vol. IA-10, no. 3, pp. 417-423, May/June 1974.

The drawback of all current-controlled variable inductors in FIGS. 4, 6, and 8-10 is that the control winding is always coupled to the inductor winding. Even with two opposing fluxes through the control winding produced by the inductor winding, there is always an asymmetry in the operation, such as shown in FIG. 7(*b*). Therefore the opposing fluxes do not completely cancel each other, resulting in undesired induced ac voltage and, consequently, increased power loss in the control winding. In addition, any asymmetry in the structure of the magnetic core and any mismatch in the two portions of the inductor winding or control winding further increase the unbalance between the opposing fluxes through the control winding and increase the undesired induced ac voltage and power loss in the control winding. In ripple-sensitive applications such as LED drivers, any additional ripple in the LED current would adversely affect the longevity of the LEDs.

Therefore, there exists a need for an inductor that provides a variable inductance with a simple control technique without significantly affecting efficiency and without significantly affecting load current.

SUMMARY OF THE INVENTION

Briefly, according to the present invention, a variable inductor comprises one or more magnetic cores providing magnetic flux paths. An inductor coil is wound around one or more inductor sections of the one or more magnetic cores. An inductor magnetic flux flows through one or more closed flux paths along the inductor sections of the magnetic core. A control coil is wound around one or more control sections of the one or more magnetic cores. A control magnetic flux flows through one or more closed flux paths along the control sections of the magnetic core. Under this arrangement, the inductor magnetic flux substantially does not flow through the control sections of the magnetic core and the control magnetic flux substantially does not flow through the inductor sections of the magnetic core. Additionally, the closed flux paths associated with the inductor magnetic flux and the closed flux paths associated with the control magnetic flux share one or more common sections of the magnetic core that do not include the control sections and inductor sections. The inductance of the variable inductor is varied by varying the control magnetic flux.

According to some of the more detailed features of the invention, variations in the control magnetic flux vary the effective permeability of the common sections of the magnetic core. These variations in the effective permeability of the common sections of the magnetic core vary the inductance of the variable inductor. Accordingly, increasing the control magnetic flux decreases the inductance of the variable inductor and decreasing the control magnetic flux increases the inductance of the variable inductor. According to other more detailed features of the invention, the variable inductor includes one or more air gaps defined by the magnetic core along at least one of the closed flux paths associated with the inductor magnetic flux or the closed flux paths associated with the control magnetic flux.

According to other more detailed features of the invention, the variable inductor further includes a control circuit for varying the inductance of the variable inductor. The control circuit varies a control current associated with the control magnetic flux. The control circuit increases the control current to decrease the inductance of the variable inductor and decreases the control current to increase the inductance of the variable inductor. The control circuit varies the control current based on at least one of the line voltage or load current.

According to the present invention, a power supply includes a converter having a variable inductor. The inductor comprises one or more magnetic cores providing magnetic flux paths. An inductor coil is wound around one or more inductor sections of the one or more magnetic cores. An inductor magnetic flux flows through one or more closed flux paths along the inductor sections of the magnetic core. A control coil is wound around one or more control sections of the one or more magnetic cores. A control magnetic flux flows through one or more closed flux paths along the control sections of the magnetic core. Under this arrangement, the inductor magnetic flux substantially does not flow through the control sections of the magnetic core and the control magnetic flux substantially does not flow through the inductor sections of the magnetic core. Additionally, the closed flux paths associated with the inductor magnetic flux and the closed flux paths associated with the control magnetic flux share one or more common sections of the magnetic core. The inductance of the variable inductor is varied by varying the control magnetic flux.

According to still other more detailed features of the present invention, the inductance of the variable inductor is adjusted based on at least one of the line voltage of the power supply or load current of the power supply. Additionally, the converter can be used for at least one of regulation of power or power factor correction.

DETAILED DESCRIPTIONS OF THE PREFERRED EMBODIMENTS

The present invention is a current-controlled variable inductor comprising a magnetic structure and a control circuit. The magnetic structure includes one or more magnetic cores and two windings, also referred to as coils. The two coils are an inductor coil and a control coil. Each coil is associated with a separate magnetic flux such that the corresponding closed flux paths share one or more high-permeability common sections of the magnetic core The inductance is varied by a control current. In an embodiment of the present invention, the control current is a dc bias current. When the current flows through the control winding, a control flux is added to the inductor magnetic flux in the shared high-permeability sections of the magnetic core. As a result, in the shared sections of the magnetic core, the effective permeability is reduced and, consequently, the inductance is decreased.

In an embodiment of the present invention, to ensure the proper magnetic flux paths, one or more air gaps are defined by the magnetic core along at least one of the closed flux paths associated with the inductor magnetic flux or the closed flux paths associated with the control magnetic flux.

Figure 1:
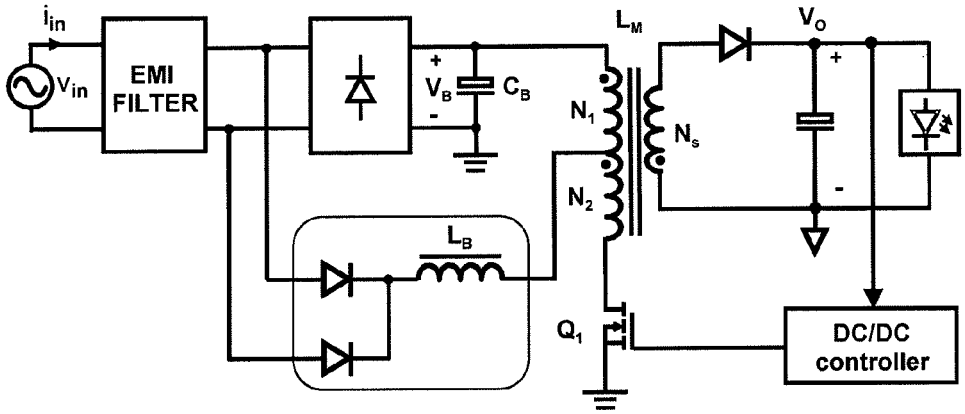
Fig. 1 (Prior Art)
FIG. 1 shows the simplified circuit diagram of a prior art single-stage PFC flyback LED driver.
Figure 2:
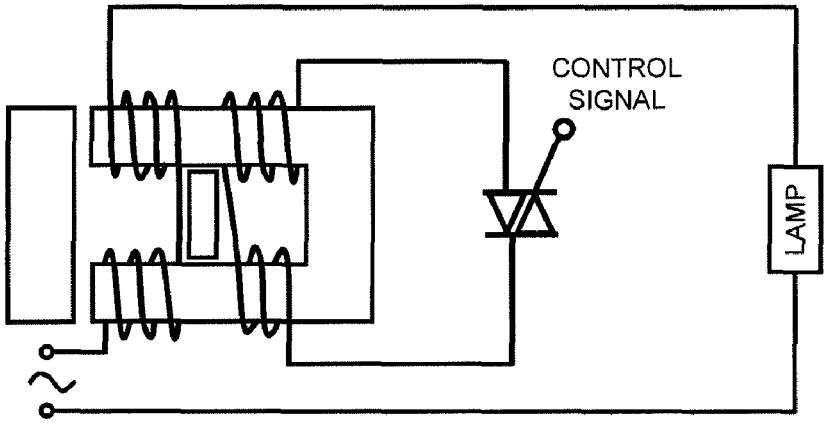
Fig. 2 (Prior Art)
FIG. 2 shows a prior art variable inductor for use in lamp ballasts.
Figure 3:
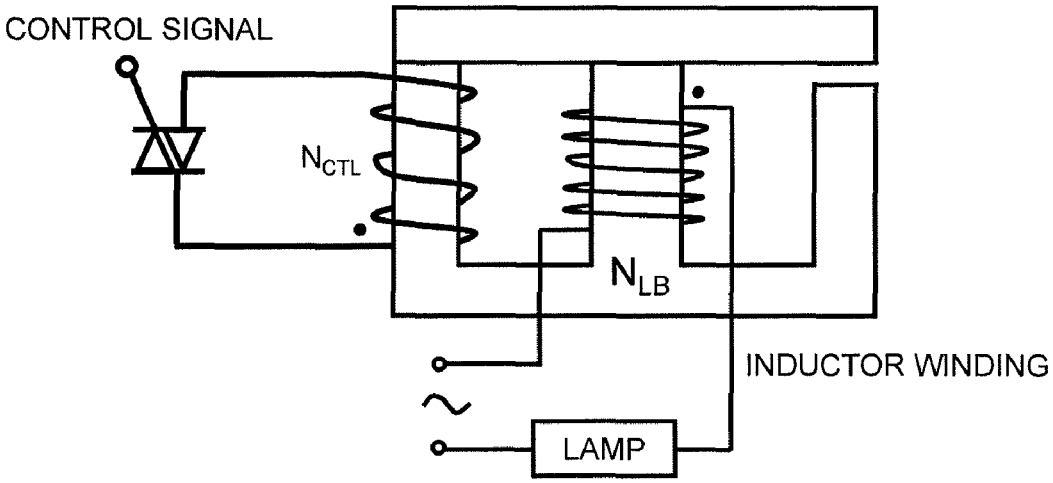
Fig. 3 (Prior Art)
FIG. 3 shows a prior art variable inductor for use in ballasts for HID lamps.
Figure 4:
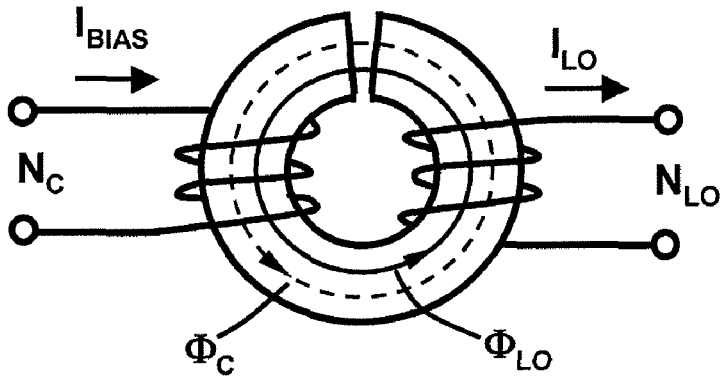
Fig. 4 (Prior Art)
FIG. 4 shows a prior art variable inductor where an inductor winding and a control winding are wound on the same magnetic core.
Figure 5:
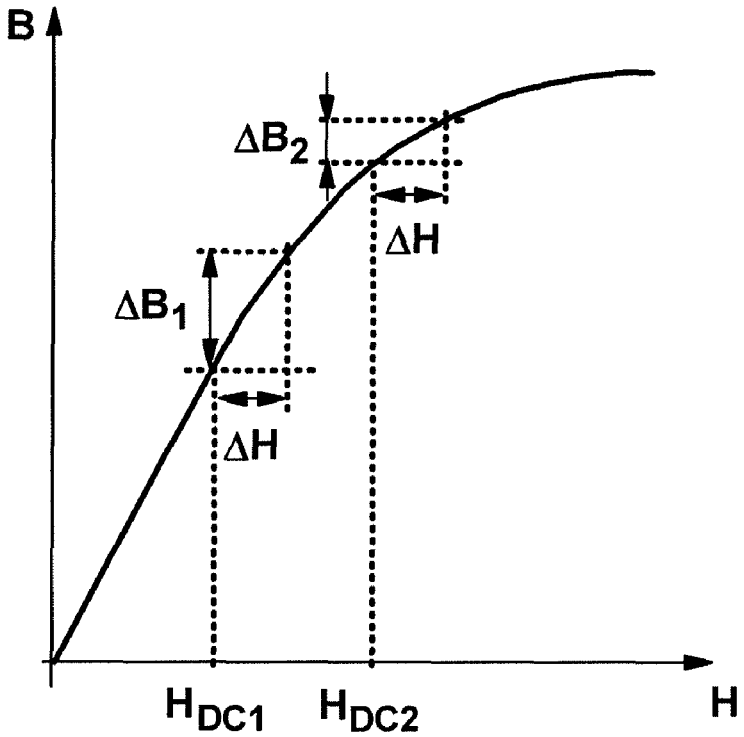
Fig. 5 (Prior Art)
FIG. 5 shows a graph of the relationship between the magnetizing field (H) and magnetic field (B) for the prior art variable inductor of FIG. 4.
Figure 6:
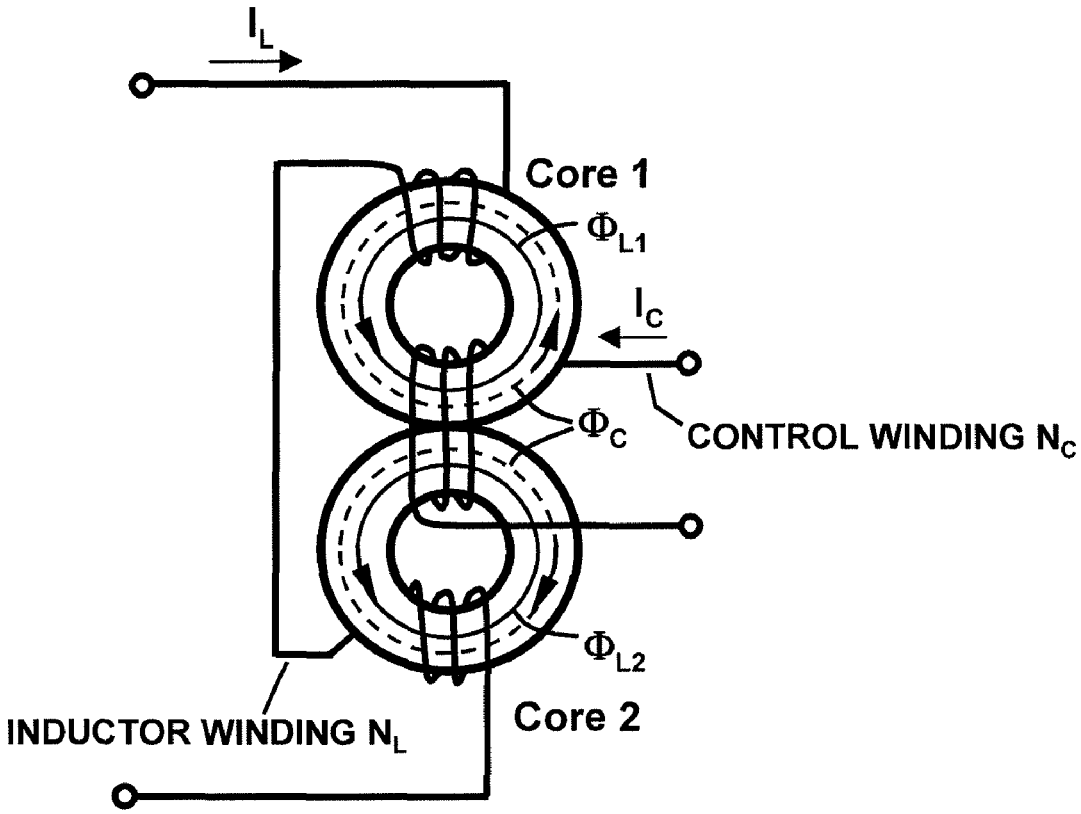
Fig. 6 (Prior Art)
FIG. 6 shows a prior art variable inductor where the inductor winding is divided into two identical portions wound on two identical toroidal cores and connected in series.
Figure 7:
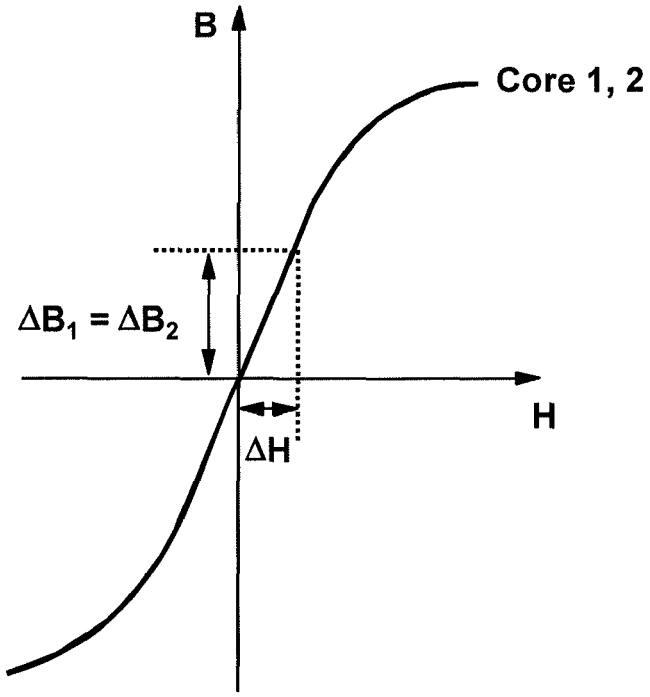
Fig. 7 (Prior Art)
FIG. 7 shows graphs of the relationship between the magnetizing field (H) and magnetic field (B) for the two individual cores of the variable inductor in FIG. 6: (a) without and (b) with a control current.
Figure 7:
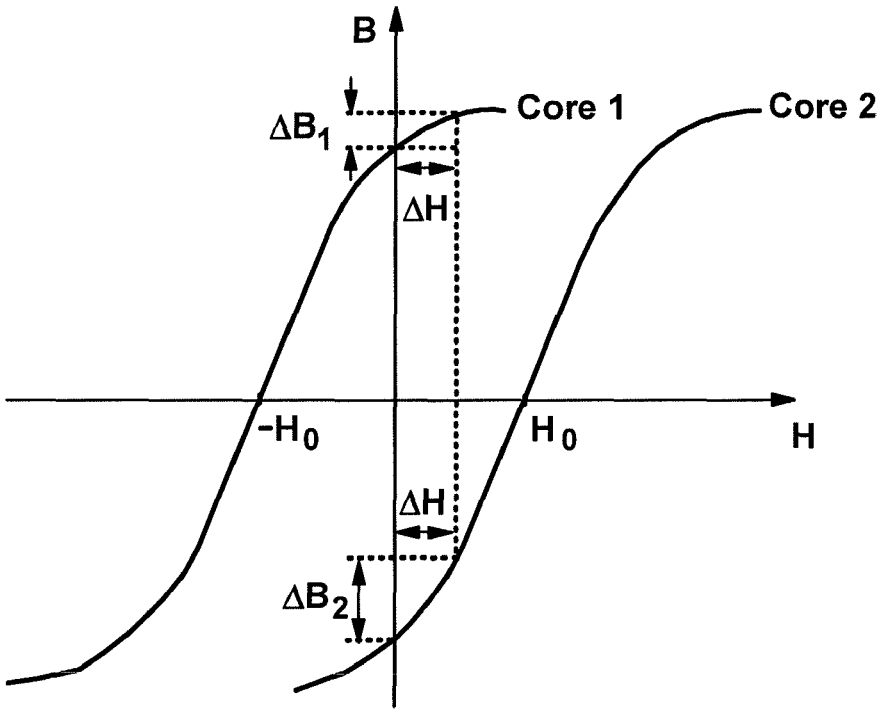
Fig. 7 (Prior Art)
Figure 8:
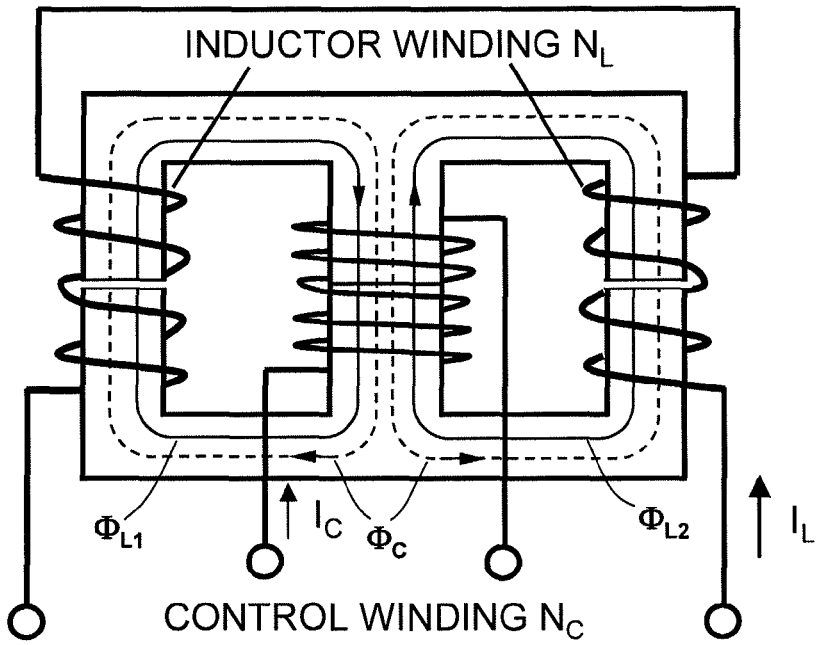
Fig. 8 (Prior Art)
FIG. 8 shows another prior art implementation of the variable inductor in FIG. 6.
Figure 9:
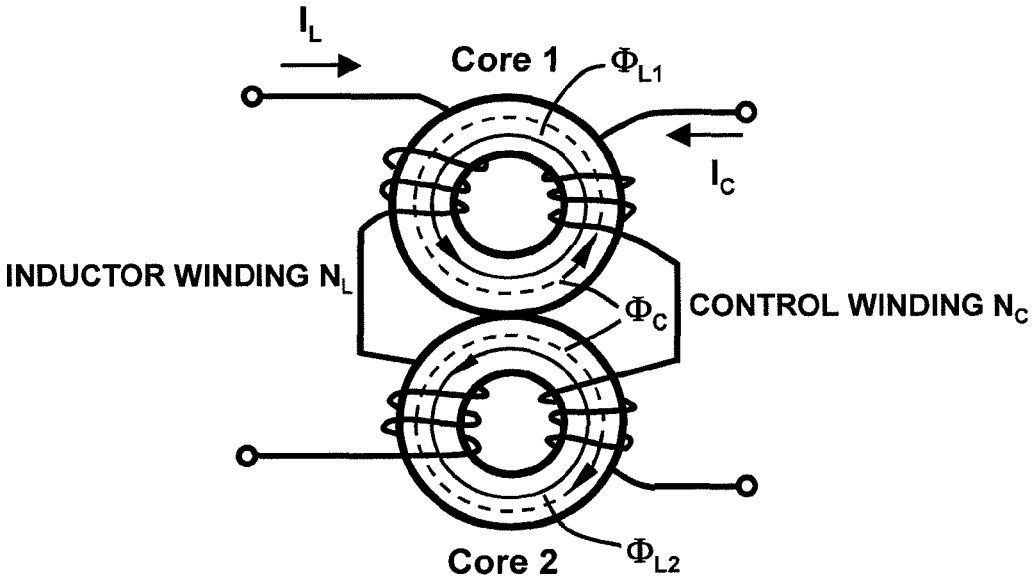
Fig. 9 (Prior Art)
FIG. 9 shows a prior art modification of the variable inductor in FIG. 6.
Figure 10:
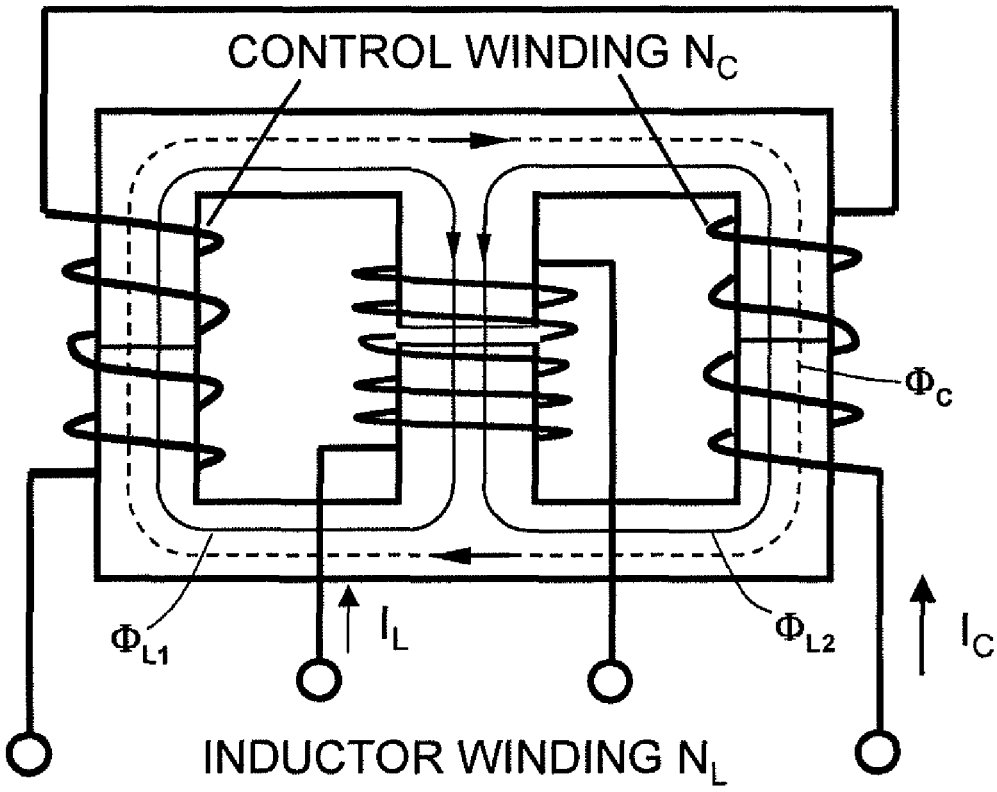
Fig. 10 (Prior Art)
FIG. 10 shows a prior art variable inductor where the control winding is divided into two identical portions wound on the outer legs of an EE core and connected in series.
Figure 11:
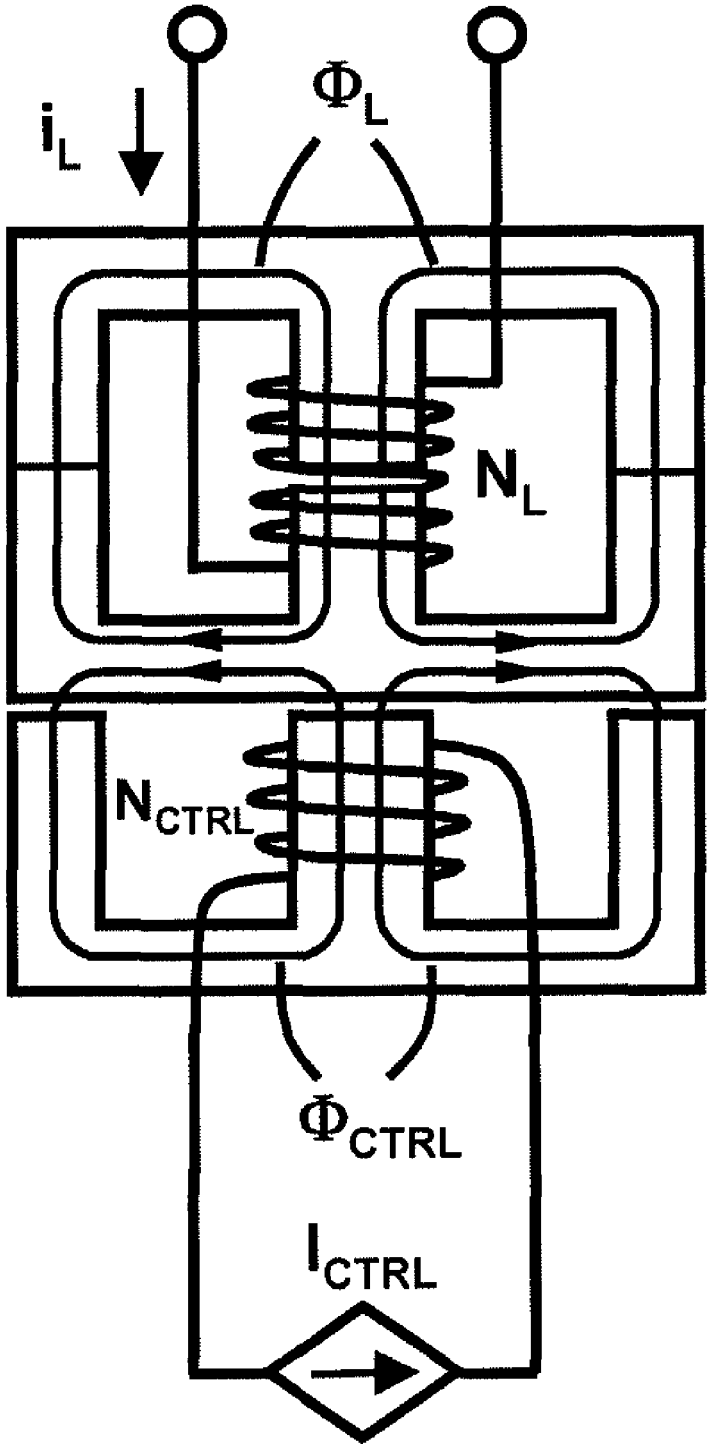
FIG. 11 shows the structure and control method of the variable inductor according to one embodiment of the present invention.
Figure 12:
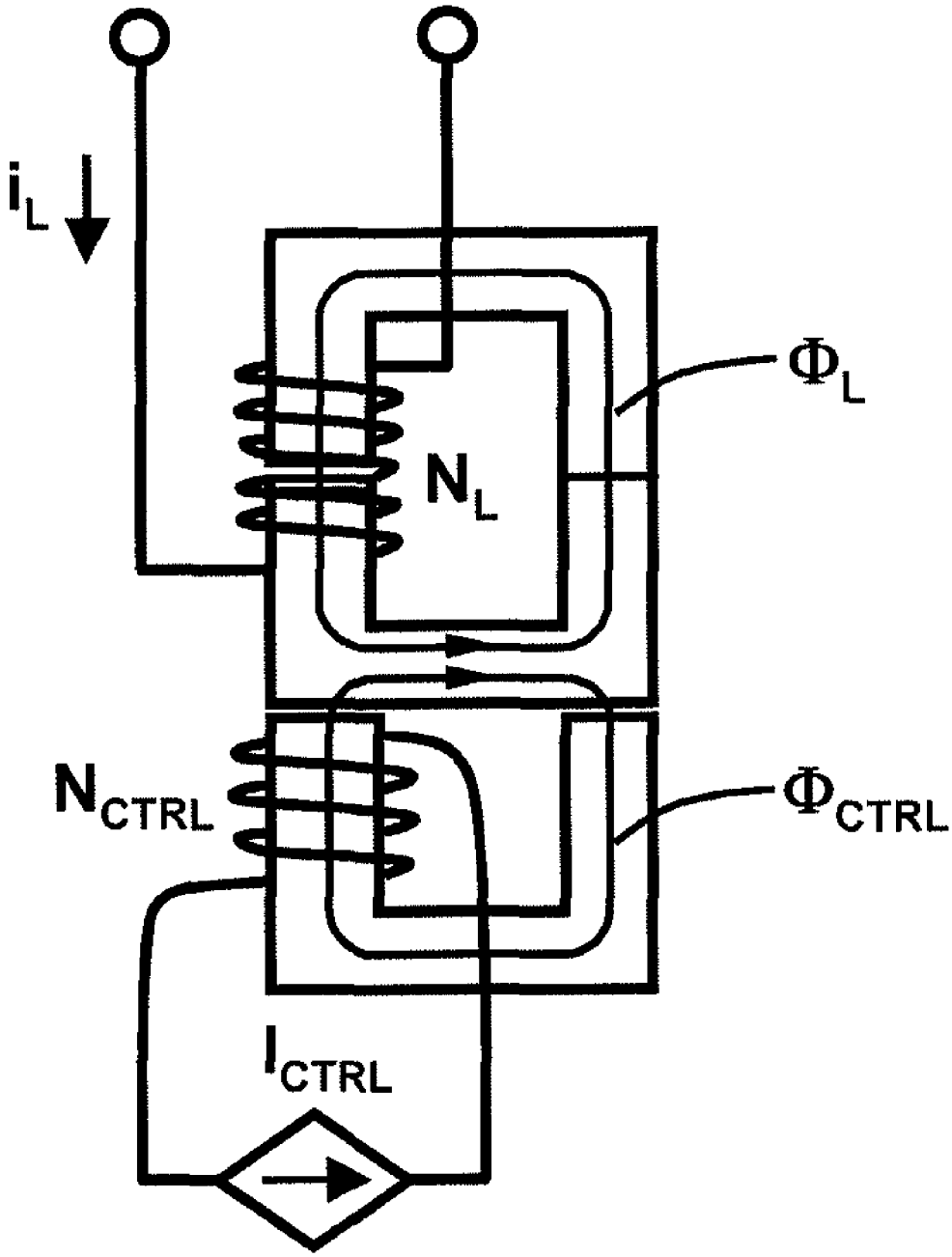
FIG. 12 shows the structure and control method of the variable inductor according to another embodiment of the present invention.
Figure 13:
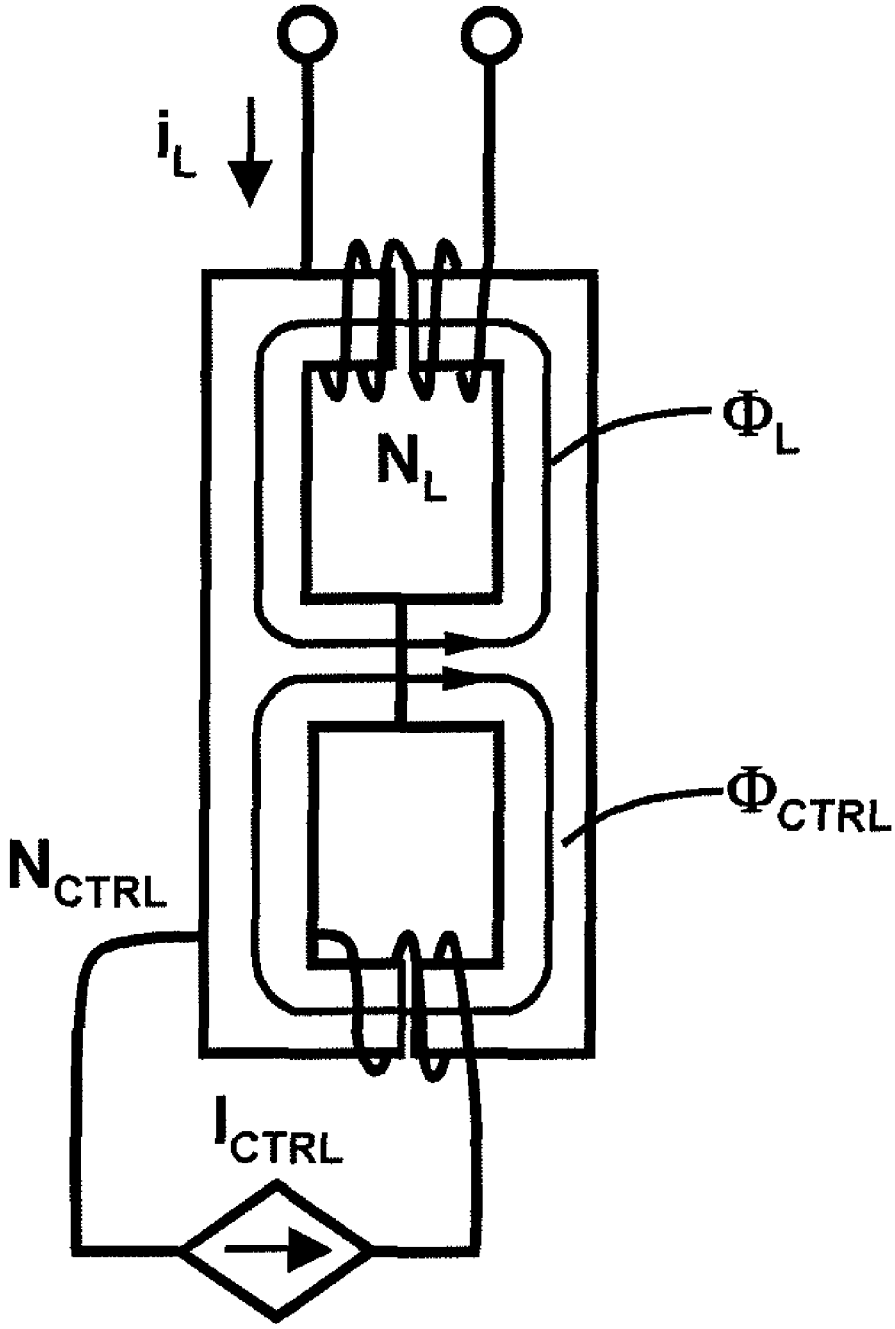
FIG. 13 shows the structure and control method of the variable inductor according to yet another embodiment of the present invention.

The one or more magnetic cores, inductor coil, control coil, and air gaps can be arranged in a number of ways while maintaining the above described magnetic flux flows. As shown in FIG. 11, described below, in one embodiment of the present invention, the inductor winding is wound around the gapped center leg of an EE core, while the control winding is wound around the center leg of an additional E core, which is closely attached to the bottom part of the EE core. As shown in FIG. 12, described below, in another embodiment of the present invention, instead of E cores, U cores are employed. As shown in FIG. 13, also described below, in yet another embodiment of the present invention, the inductor winding and the control winding are wound around the two gapped outer legs of an EE core.

FIG. 11 shows the structure and control method of the variable inductor according to one embodiment of the present invention. The basic inductor is implemented with an EE core and inductor coil, winding $N_L$. The section of the EE core winding $N_L$ is wound around is the inductor section. An additional half core (E-type) with a control coil, winding $N_{CTRL}$ is closely attached to the bottom part of the EE core so that the EE core and E core are separated by small air gaps. Together, the EE core and E core are the magnetic core of the inductor. The section of the E core winding $N_{CTRL}$ is wound around is the control section.

Four closed flux paths corresponding to this arrangement are shown in FIG. 11. A first closed flux path is depicted by the closed loop in the upper left of the magnetic core. Part of an inductor magnetic flux, $\Phi_L$, associated with winding $N_L$ flows through the first closed flux path in a clockwise direction. The inductor magnetic flux substantially does not flow through the control section. A second closed flux path is depicted by another closed loop in the lower left of the magnetic core. Part of a control magnetic flux, $\Phi_{CTRL}$, associated with winding $N_{CTRL}$ flows through the second closed flux path in a counter clockwise direction. The control magnetic flux substantially does not flow through the inductor section. Additionally, the left half of the bottom part of the EE core, which does not include the inductor section or control section, serves as a common section of the magnetic core. The first closed flux path and second closed flux path share the common section.

A third closed flux path is depicted by the closed loop in the upper right of the magnetic core. Part of the inductor magnetic flux, $\Phi_L$, associated with winding $N_L$ flows through the third closed flux path in a counterclockwise direction. The inductor magnetic flux substantially does not flow through the control section. A fourth closed flux path is depicted by another closed loop in the lower right of the magnetic core. Part of the control magnetic flux, $\Phi_{CTRL}$, associated with winding $N_{CTRL}$ flows through the fourth closed flux path in a clockwise direction. The control magnetic flux substantially does not flow through the inductor section. Additionally, the right half of the bottom part of the EE core, which does not include the inductor section or control section, serves as another common section of the magnetic core. The third closed flux path and fourth closed flux path share the common section.

The inductance L of the inductor is controlled by a control current $I_{CTRL}$. The variable inductor can include a control circuit to provide the control current $I_{CTRL}$. The control circuit can vary the control current based on at least one of line voltage or load current. When control current $I_{CTRL}$ flows through control winding $N_{CTRL}$, the control magnetic flux $\Phi_{CTRL}$ is added to the inductor magnetic flux $\Phi_L$ in the bottom part of the inductor EE core. As a result, the effective permeability is reduced in the bottom part of the EE core and consequently, the inductance is decreased. The reduction of the inductance is proportional to the applied control current.

FIG. 12 shows the structure and control method of the variable inductor according to another embodiment of the invention. The basic inductor is implemented with a UU core and winding $N_L$. The section of the UU core winding $N_L$ is wound around is the inductor section. An additional half core (U-type) with a winding $N_{CTRL}$ is closely attached to the bottom part of the UU core. Together, the UU core and U core are the magnetic core of the inductor. The section of the U core winding $N_{CTRL}$ is wound around is the control section.

Two closed flux paths corresponding to this arrangement are shown in FIG. 12. A first closed flux path is depicted by the closed loop in the UU core. An inductor magnetic flux, $\Phi_L$, associated with winding $N_L$ flows through the first closed flux path in a counter clockwise direction. The inductor magnetic flux substantially does not flow through the control section. A second closed flux path is depicted by another closed loop in the lower portion of the magnetic core. A control magnetic flux, $\Phi_{CTRL}$, associated with winding $N_{CTRL}$ flows through the second closed flux path in a clockwise direction. The control magnetic flux substantially does not flow through the inductor section. Additionally, the bottom part of the UU core, which does not include the inductor section or control section, serves as the common section of the magnetic core. The first closed flux path and second closed flux path share the common section.

The inductance L is controlled by a control current $\Phi_{CTRL}$ provided by the control circuit, similarly as in FIG. 11. When control current $I_{CTRL}$ flows through control winding $N_{CTRL}$, a control magnetic flux $c\Phi_{CTRL}$ is added to the inductor magnetic flux $\Phi_L$ in the bottom part of the UU core. As a result, the effective permeability is reduced in the bottom of the UU core and consequently the inductance is decreased. The reduction of the inductance is proportional to the applied control current.

FIG. 13 shows the structure and control method of the variable inductor according to yet another embodiment of the invention. The basic inductor is implemented with an EE core and winding $N_L$ wound on one outer leg of the EE core. The section of the EE core winding $N_L$ is wound around is the inductor section. The control winding $N_{CTRL}$ is wound on the other outer leg of the EE core. The section of the EE core winding $N_{CTRL}$ is wound around is the control section.

Two closed flux paths corresponding to this arrangement are shown in FIG. 13. A first closed flux path is depicted by the closed loop in the top portion of the EE core. An inductor magnetic flux, $\Phi_L$, associated with winding $N_L$ flows through the first closed flux path in a counter clockwise direction. The inductor magnetic flux substantially does not flow through the control section. A second closed flux path is depicted by another closed loop in the lower portion of the EE core. A control magnetic flux, $\Phi_{CTRL}$, associated with winding $N_{CTRL}$ flows through the second closed flux path in a clockwise direction. The control magnetic flux substantially does not flow through the inductor section. Additionally, the center leg the EE core, which does not include the inductor section or control section, serves as the common section of the magnetic core. The first closed flux path and second closed flux path share the common section.

The inductance L is controlled by a control current $\Phi_{CTRL}$ provided by the control circuit, similarly as in FIG. 11. When control current $\Phi_{CTRL}$ flows through control winding $N_{CTRL}$, a control magnetic flux $\Phi_{CTRL}$ is added to the inductor magnetic flux $\Phi_L$ in the center leg of the EE core. As a result, the effective permeability is reduced in the center leg of the EE core and consequently the inductance is decreased. The reduction of the inductance is proportional to the applied control current.

In another embodiment of the invention, a power supply includes a converter having a variable inductor as described above. The converter can be used for at least one of regulation of power or power factor correction. The inductance of the variable inductor can be adjusted based on at least one of the line voltage or load current of the power supply.

Figure 14:
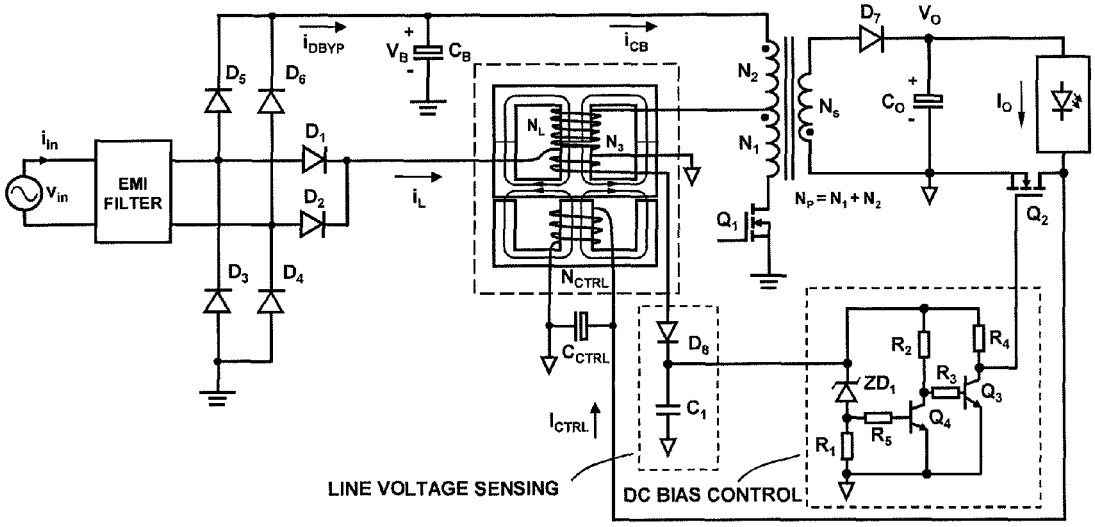
FIG. 14 shows an implementation of the variable inductor according to the embodiment of the present invention shown in FIG. 11 employed in a single-stage PFC flyback LED driver.

FIG. 14 shows an implementation of the variable inductor according to the embodiment shown in FIG. 11 employed in a single-stage PFC flyback LED driver for the universal-line voltage. The control circuit includes switch $Q_2$, connected in parallel with control winding $N_{CTRL}$, a dc bias control circuit, and a line voltage sensing circuit. As described above, a high PFC inductance is required at high line and a lower PFC inductance is required at low line to limit the bulk-capacitor voltage and to meet the IEC 61000-3-2 Class C and JIS C 61000-3-2 Class C standard requirements. Therefore, the dc bias circuit is controlled by the sensed line voltage.

As shown in FIG. 14, the line voltage is sensed by a circuit comprising winding $N_3$ wound around the boost-inductor core, diode $D_8$, and capacitor $C_1$. The load current is used as the control current ($I_{CTRL}$ in FIG. 11) to reduce complexity and loss of efficiency. When main switch $Q_1$ is turned on, diode $D_8$ is forward biased, peak charging capacitor $C_I$ with a maximum voltage $V_{C1MAX}=(\sqrt{2}V_{LINE}-V_B N_1/N_P)(N_3/N_{LB})$, where $N_1$, $N_P$, and $N_{LB}$ are the number of turns of the feedback winding, primary winding of the flyback transformer, and the boost-inductor winding, respectively; $V_{LINE}$ is the rms value of the line voltage; and $V_B$ is the bulk-capacitor voltage. A proper number of turns $N_3$ is chosen so that the voltage across capacitor $C_1$ turns on Zener diode $ZD_1$ only at high line (180-270 Vrms). When $ZD_1$ is turned on, switch $Q_4$ is turned on and switch $Q_3$ is turned off. Accordingly, the gate-to-source voltage of MOSFET $Q_2$ is high and $Q_2$ is turned on. The load current flows through switch $Q_2$ and the control current of control winding $N_{CTRL}$ is approximately zero. Therefore, the boost inductance remains unchanged.

It should be noted that the turn-on resistance of switch $Q_2$ should be negligible compared to the resistance of control winding $N_{CTRL}$ to prevent a substantial current flowing through the control winding at high line. Otherwise, the effective boost inductance would become lower and voltage $V_B$ would increase to an undesirable level. At low line (90-135 Vrms) the voltage across capacitor $C_1$ is lower than the turn-on voltage of $ZD_1$, $Q_4$ is turned off, and $Q_3$ is turned on. As a result, the gate-to-source voltage of MOSFET $Q_2$ is low and $Q_2$ is turned off. The entire load current flows through the control winding. Therefore, the boost inductance is reduced.

Figure 15:
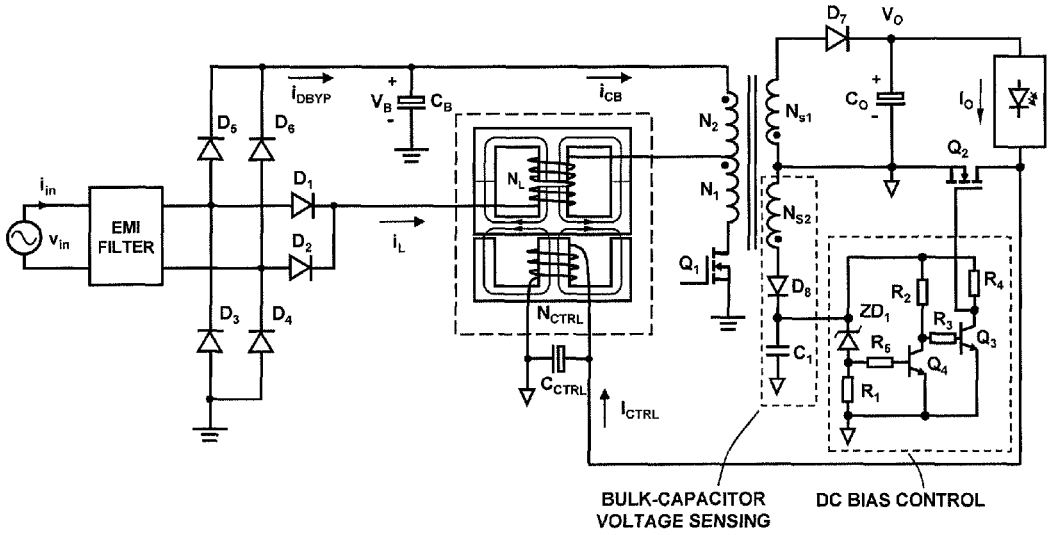
FIG. 15 shows another implementation of the variable inductor according to the embodiment of the present invention shown in FIG. 11 employed in a single-stage PFC flyback LED driver.

FIG. 15 shows another implementation of the variable inductor according to the embodiment of the invention shown in FIG. 11 employed in a single-stage PFC flyback LED driver for the universal-line voltage. The only difference between the implementations of the variable inductor in FIGS. 15 and 14 is the line voltage sensing. In FIG. 15, the line voltage is sensed by sensing the bulk-capacitor voltage, which is approximately equal to the peak value of the rectified line voltage. The bulk-capacitor voltage sensing circuit comprises auxiliary winding $N_{82}$ of the flyback transformer, diode $D_8$, and capacitor $C_1$. When main switch $Q_1$ is turned on, diode $D_8$ is forward biased peak charging capacitor $C_1$ with a maximum voltage $V_{C1MAX}=V_B N_{S2}/N_P$. A proper turns ratio $N_{S2}/N_P$ is chosen so that the voltage across capacitor $C_1$ turns on Zener diode $ZD_1$ only at high line, similarly as in the control circuit in FIG. 14.

Figure 16:
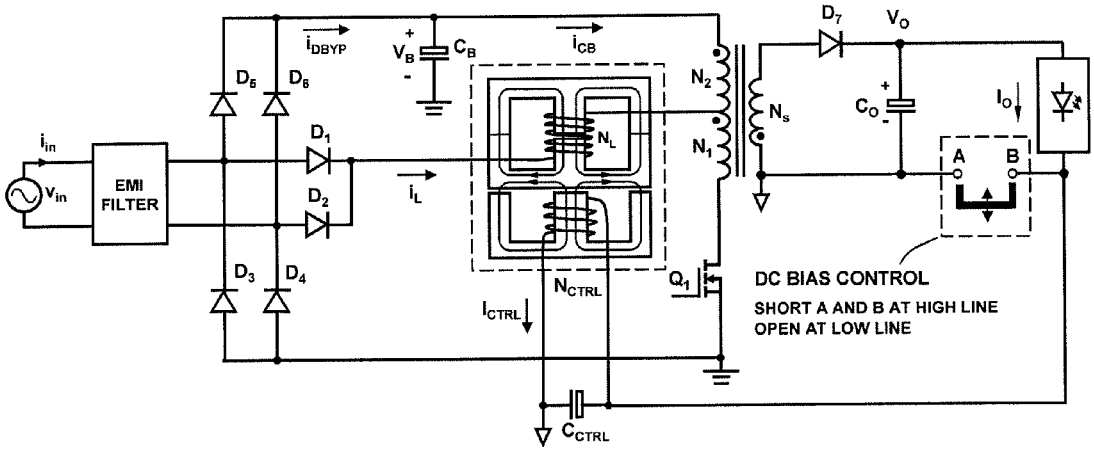
FIG. 16 shows yet another implementation of the variable inductor according to the embodiment of the present invention shown in FIG. 11 employed in a single-stage PFC flyback LED driver.

FIG. 16 shows yet another implementation of the variable inductor according to the embodiment of the invention shown in FIG. 11 employed in a single-stage PFC flyback LED driver for the universal-line voltage. In FIG. 16, a jumper is connected between terminals A and B in parallel with the control winding $N_{CTRL}$. When the line voltage is in the low range, the jumper is removed. Therefore, the whole load current flows through the control winding, resulting in a decreased boost inductance. However, when the line voltage is in the high range, the jumper shorts terminals A and B, and the load current is prevented from flowing through the control winding. Therefore, the boost inductance remains unchanged.

Figure 17:
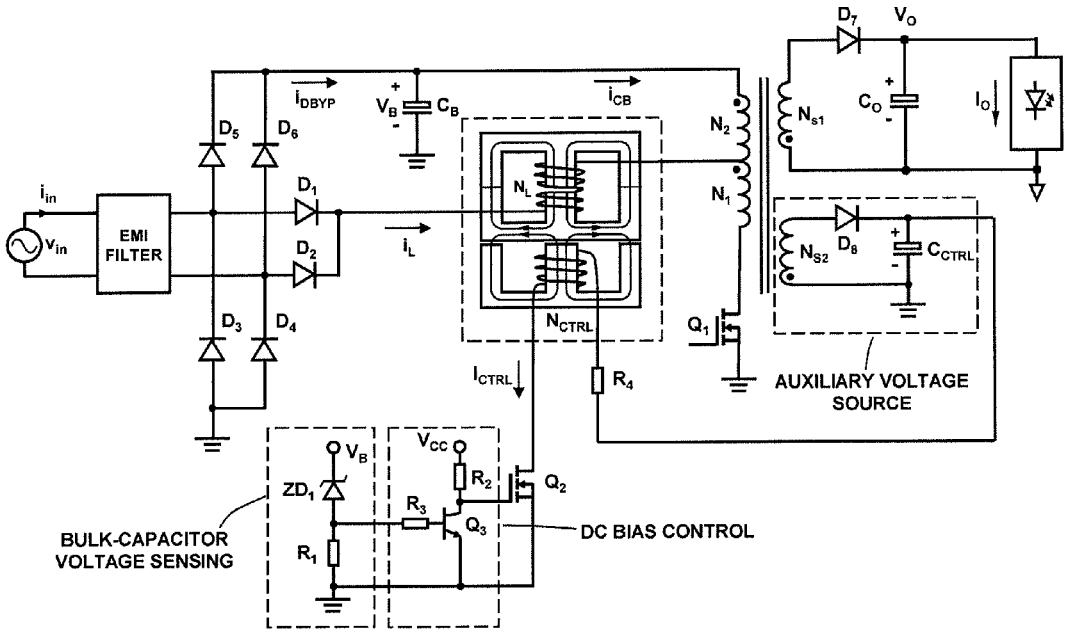
FIG. 17 shows still another implementation of the variable inductor according to the embodiment of the present invention shown in FIG. 11 employed in a single-stage PFC flyback LED driver.

Finally, FIG. 17 shows still another implementation of the variable inductor according to the embodiment of the invention shown in FIG. 11 employed in a single-stage PFC flyback LED driver for the universal-line voltage. The control circuit includes switch $Q_2$, connected in series with the control winding $N_{CTRL}$, an auxiliary voltage source, a current limiting resistor $R_4$, a dc bias control circuit, and a bulk-capacitor voltage sensing circuit.

In FIG. 17, the line voltage is sensed by directly sensing the bulk-capacitor voltage. The bulk-capacitor voltage sensing circuit comprises Zener diode $ZD_1$ and current limiting resistor $R_1$. The auxiliary voltage source is implemented as an auxiliary flyback output voltage through winding $N_{S2}$ of the flyback transformer, diode $D_8$, and capacitor $C_{CTRL}$. The clamp voltage of Zener diode $ZD_1$ is set lower than the minimum level of $V_B$ at high line but higher than the maximum level of $V_B$ at low line. Therefore, at high line, $ZD_1$ is turned on, switch $Q_3$ is turned on, and switch $Q_2$ is turned off. As a result, no control current flows through control winding $N_{CTRL}$ to bias the boost-inductor core. At low line, $ZD_1$ as well as switch $Q_3$ are turned off, and switch $Q_2$ is turned on. Consequently, a control current $I_{CTRL}$ flows through control winding $N_{CTRL}$, resulting in a decreased boost inductance.

The examples and embodiments described herein are non-limiting examples. The invention is described in details with respect to exemplary embodiments, and it will now be apparent from the foregoing to those skilled in the art that changes and modifications may be made without departing from the invention in its broader aspects, and the invention, therefore, as defined in the claims, is intended to cover all such changes and modifications which fall within the true spirit of the invention.

The invention claimed is:

1. A variable inductor comprising:

one or more magnetic cores providing magnetic flux paths;

an inductor coil wound around one or more inductor sections of the one or more magnetic cores, wherein an inductor magnetic flux flows through one or more closed flux paths along the inductor sections of the magnetic core; and a control coil wound around one or more control sections of the one or more magnetic cores, wherein a control magnetic flux flows through one or more closed flux paths along the control sections of the magnetic core, wherein the inductor magnetic flux substantially does not flow through the control sections of the magnetic core, wherein the control magnetic flux substantially does not flow through the inductor sections of the magnetic core, wherein the closed flux paths associated with the inductor magnetic flux and the closed flux paths associated with the control magnetic flux share one or more common sections of the magnetic core that do not include the control sections and inductor sections, and wherein the inductance of said variable inductor is varied by varying said control magnetic flux.

2. The variable inductor of claim 1, wherein variations in the control magnetic flux vary the effective permeability of the common sections of the magnetic core.

3. The variable inductor of claim 2, wherein variations in the effective permeability of the common sections of the magnetic core vary the inductance of said variable inductor.

4. The variable inductor of claim 1, wherein increasing the control magnetic flux decreases the inductance of said variable inductor.

5. The variable inductor of claim 1, wherein decreasing the control magnetic flux increases the inductance of said variable inductor.

6. The variable inductor of claim 1, further comprising one or more air gaps defined by the magnetic core along the closed flux paths associated with the inductor magnetic flux.

7. The variable inductor of claim 1, further comprising one or more air gaps defined by the magnetic core along the closed flux paths associated with the control magnetic flux.

8. The variable inductor of claim 1, further comprising a control circuit for varying the inductance of said variable inductor.

9. The variable inductor of claim 8, wherein said control circuit varies a control current associated with said control magnetic flux.

10. The variable inductor of claim 9, wherein said control circuit increases the control current to decrease the inductance of said variable inductor.

11. The variable inductor of claim 9, wherein said control circuit decreases the control current to increase the inductance of said variable inductor.

12. The variable inductor of claim 9, wherein said control circuit varies the control current based on the line voltage.

13. The variable inductor of claim 9, wherein said control circuit varies the control current based on the load current.

14. A power supply comprising:

a converter having a variable inductor, said inductor comprising:

one or more magnetic cores providing magnetic flux paths;

an inductor coil wound around one or more inductor sections of the one or more magnetic cores, wherein an inductor magnetic flux flows through one or more closed flux paths along the inductor sections of the magnetic core; and a control coil wound around one or more control sections of the one or more magnetic cores, wherein a control magnetic flux flows through one or more closed flux paths along the control sections of the magnetic core, wherein the inductor magnetic flux substantially does not flow through the control sections of the magnetic core, wherein the control magnetic flux substantially does not flow through the inductor sections of the magnetic core, wherein the closed flux paths associated with the inductor magnetic flux and the closed flux paths associated with the control magnetic flux share one or more common sections of the magnetic core that does not include the control sections and inductor sections, wherein the inductance of said variable inductor is varied by varying said control magnetic flux.

15. The power supply of claim 14, wherein the inductance of said variable inductor is adjusted based on the line voltage of the power supply.

16. The power supply of claim 14, wherein the inductance of said variable inductor is adjusted based on the load current of the power supply.

17. The power supply of claim 14, wherein said converter is used for regulation of power.

18. The power supply of claim 14, wherein said converter is used for power factor correction.

* * * * *